US008733020B2

(12) United States Patent
Khoshkish

(10) Patent No.: US 8,733,020 B2
(45) Date of Patent: May 27, 2014

(54) DOOR VIEWER SECURITY COVER

(76) Inventor: Kamran Khoshkish, Tehran (IR)

( * ) Notice: Subject to any disclaimer, the term of this patent is extended or adjusted under 35 U.S.C. 154(b) by 0 days.

(21) Appl. No.: 13/295,121

(22) Filed: Nov. 14, 2011

(65) Prior Publication Data

US 2013/0118081 A1 May 16, 2013

(51) Int. Cl.
*E06B 7/28* (2006.01)

(52) U.S. Cl.
USPC ..... 49/171

(58) Field of Classification Search
USPC ..... 49/163, 169, 171
See application file for complete search history.

(56) References Cited

U.S. PATENT DOCUMENTS

| | | | | | |
|---|---|---|---|---|---|
| 1,648,279 | A | * | 11/1927 | Mumbrauer | 49/171 |
| 2,124,525 | A | * | 7/1938 | Frankel | 49/171 |
| 2,286,353 | A | * | 6/1942 | Ehehalt, Jr. | 359/636 |
| 2,304,995 | A | * | 12/1942 | Frankel | 49/171 |
| 2,581,234 | A | * | 1/1952 | Bloom | 359/629 |
| 3,973,835 | A | | 8/1976 | Miyakawa | |
| 4,127,967 | A | * | 12/1978 | Franzl | 49/171 |
| 4,257,670 | A | | 3/1981 | Legrand | |
| 4,719,720 | A | * | 1/1988 | Olsen | 49/171 |
| 4,726,670 | A | | 2/1988 | Sherrard | |
| 4,809,320 | A | | 2/1989 | Hawkins | |
| 4,869,021 | A | * | 9/1989 | Gregory | 49/171 |
| 5,078,470 | A | | 1/1992 | Milman | |
| 5,883,738 | A | * | 3/1999 | Funatsu | 359/409 |
| 6,254,303 | B1 | * | 7/2001 | Falat et al. | 403/348 |
| 7,578,255 | B2 | | 8/2009 | Pittenger | |
| 2003/0204997 | A1 | | 11/2003 | Harter | |
| 2006/0260196 | A1 | | 11/2006 | Cheng | |
| 2011/0099907 | A1 | * | 5/2011 | Anderson et al. | 49/171 |
| 2013/0036675 | A1 | * | 2/2013 | Burton et al. | 49/386 |

OTHER PUBLICATIONS

Search Report and Written Opinion from PCT/US2012/053728.

* cited by examiner

*Primary Examiner* — Katherine Mitchell
*Assistant Examiner* — Scott Denion
(74) *Attorney, Agent, or Firm* — Edell, Shapiro & Finnan, LLC

(57) ABSTRACT

The present invention is directed toward a security cover for a door viewer such as a peephole. The security cover includes a housing having a forward opening configured to align with the peephole, a rearward viewing port, and an eyecup. The security cover further includes a shutter mechanism that is manually repositionable from a closed position to an opened position via engagement of an actuator. In operation, the security cover is coupled to a door such that it covers the door viewer.

11 Claims, 11 Drawing Sheets

DOOR VIEWER SECURITY COVER

FIELD OF THE INVENTION

The present invention relates to a security cover for a door viewer device such as a peephole.

BACKGROUND OF THE INVENTION

Door viewer devices are security devices that permit a viewer located on one side of the door (e.g., the inside of the door) to observe callers located on the other side of the door (e.g., the outside of the door). Such door viewer devices typically include a lens system that generates a virtual image of the various objects located in front of the door. In operation, a user positioned behind the door peers through the door viewer device to view the immediate area surrounding the door, thereby enabling the person to confirm the identity of persons or objects before opening the door. Conventional door viewer devices suffer from several disadvantages. First, conventional door viewer devices permit two-way viewing. That is, while door viewer devices permit the viewer on the inside to view the area located in front of the door, they further permit a viewer positioned in front of the door to view the area proximate the rear side of the door. In addition, conventional door viewer devices permit outside viewers (i.e., persons located in front of the door) to view changes in light that occur when the insider viewer approaches the door and looks through the peephole. By noting changes in light within the peephole (e.g., from light to dark), the outside viewer is alerted to the fact that someone is located within the structure (e.g., the home, apartment, business, etc.) and is positioned behind the door, which compromises the security of the persons located within the structure.

Thus, it would be desirable to provide a security device that prevents outside viewers from viewing into the secured area (e.g., a house, office, etc.), as well as enables an insider viewer to look through the door viewer device without generating changes in light that might occur during viewing.

SUMMARY OF THE INVENTION

The present invention is directed toward a security cover for a door viewer device such as a peephole. The security cover includes a housing including a forward aperture, a rearward aperture aligned with the forward aperture, and a shutter mechanism disposed between the apertures. The shutter mechanism is repositionable from a closed position to an opened position via engagement of an actuator. In operation, the security cover is coupled to a door such that the cover encloses the peephole and the forward aperture is aligned with the viewing port of the peephole. The cover may further include an eyecup secured to the rearward plate.

BRIEF DESCRIPTION OF THE DRAWINGS

Like reference numerals have been used to identify like elements throughout this disclosure.

DETAILED DESCRIPTION OF THE INVENTION

Figure 1A:
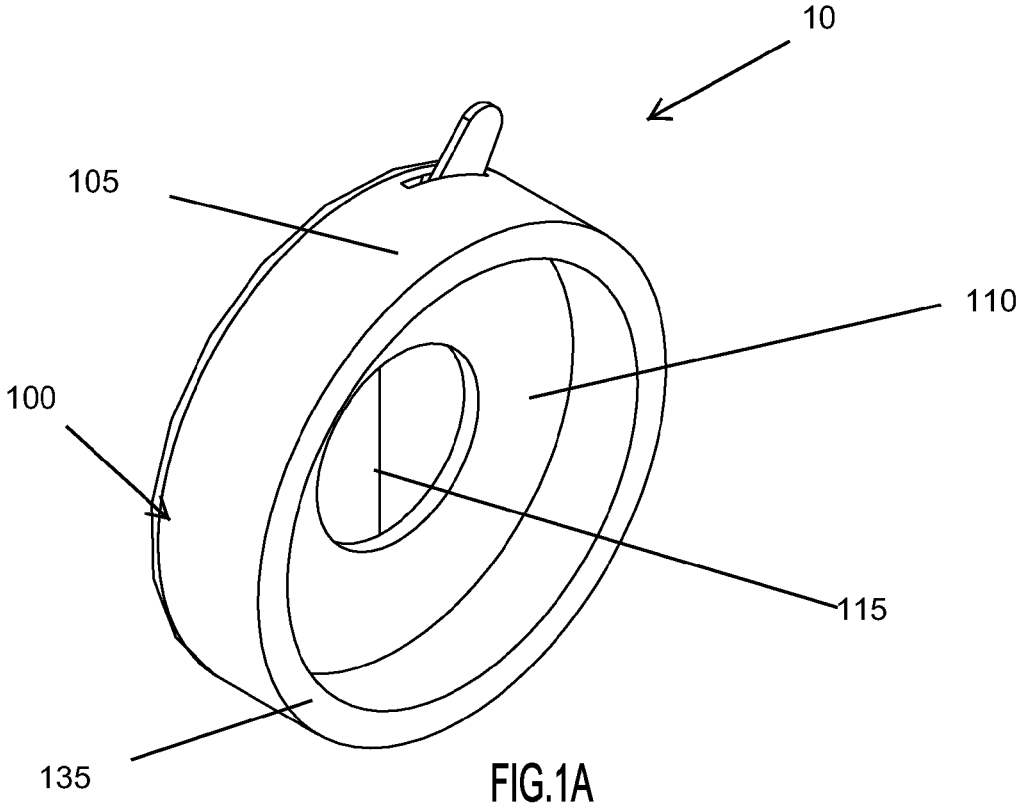
FIG. 1A illustrates a front perspective view of a security cover for a door viewer in accordance with an aspect of the present invention.
Figure 1B:
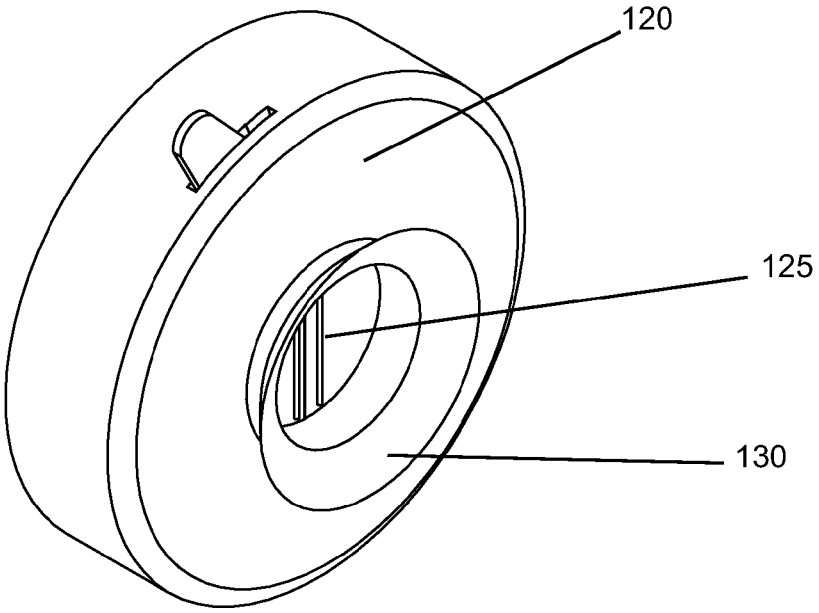
FIG. 1B illustrates a rear perspective view of the security cover shown in FIG. 1A.

FIGS. 1A and 1B illustrate a security cover for a door view in accordance with an embodiment of the invention. As shown, the security cover 10 includes a housing 100 having a generally cylindrical side wall 105, an annular forward plate 110 defining a forward aperture 115 and an annular rearward plate 120 defining a rearward or viewing aperture 125. An eyecup or eye shield 130 (e.g., similar to those found on binoculars) is coupled to the rearward plate 120, surrounding the viewing aperture. As shown, the forward plate 110 is inset within the body 100, defining a forward, generally annular rim 135 operable to contact the door surface. The rim 135 may be treated such that it couples to the door surface. By way of example, the rim 135 may be coated with an adhesive. In other embodiments, the security cover 10 may include one or more fastening members (e.g., grommets) extending radially from the housing body 100 to permit fasteners such nails or screws to be utilized to secure the cover 10 to the door. In operation, the security cover 10 is connected to the rear surface of a door such that the rim 135 surrounds the viewing port of the door viewer, and such that the forward aperture generally aligns with the viewing port. Once connected to the door, the inside viewer (i.e., the person located on the back side (or inside) of the door) places an eye against the eyecup 130, looks through the rearward 125 and forward 115 apertures and through the door viewer.

Figure 2:
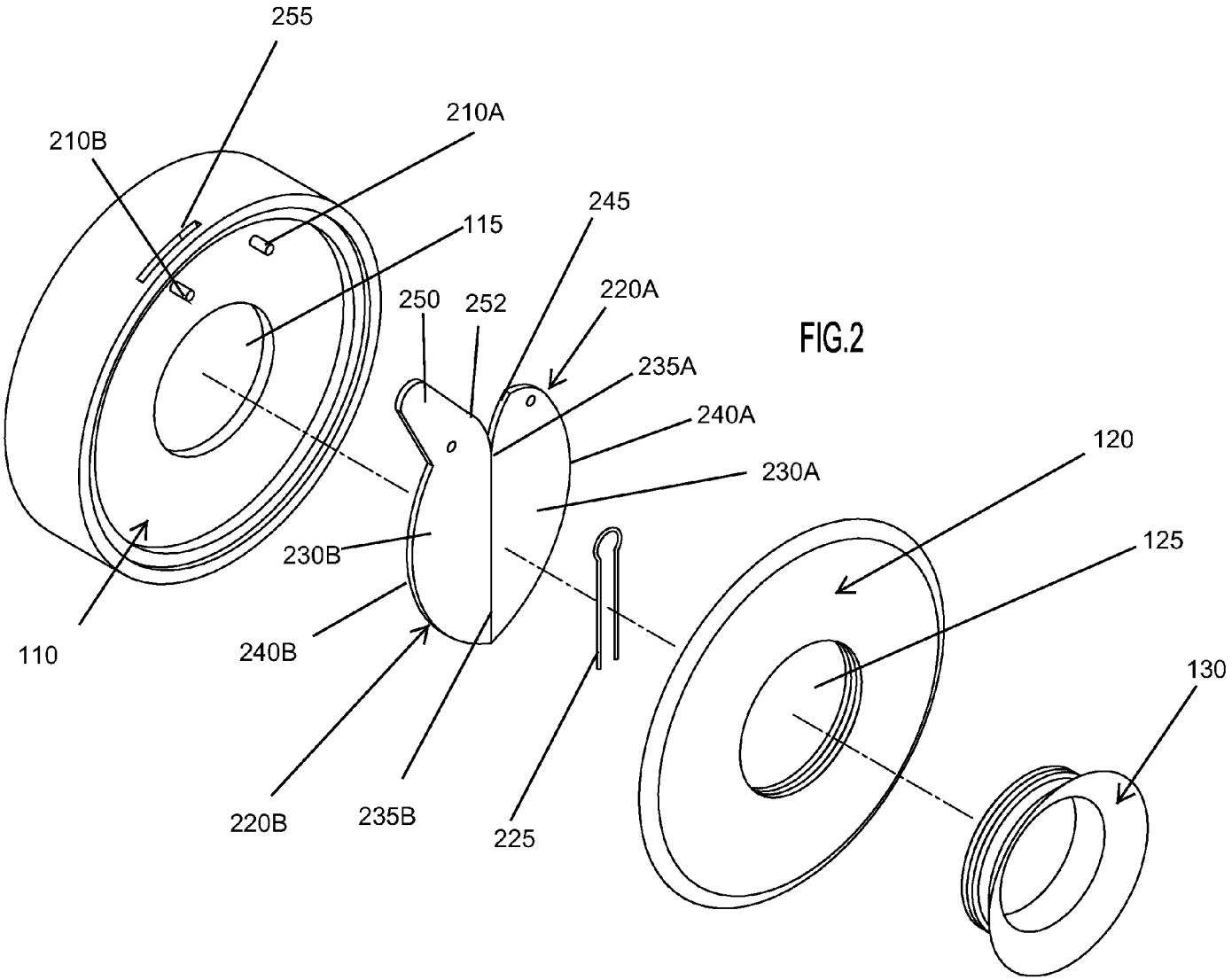
FIG. 2 illustrates an exploded view of the security cover shown in FIG. 1A.

The security cover 10 further includes a shutter mechanism disposed between the apertures 115, 125 operable to selectively open and close the viewing aperture 125. Referring to FIG. 2, the rear side 205 of the forward plate 110 includes a first post 210A laterally spaced from a second post 210B. Each post 210A, 210B extends axially from the rear side or the forward plate 110. A first shutter member 220A is pivotally mounted on the first post 210A and a second shutter member 220B pivotally mounted on the second post 210B. The shutter members 220A, 220B may be biased towards the center of the aperture (i.e., towards each other) via a biasing member 225 (e.g., a spring) that spans the members.

The first shutter member 220A includes a body 230A possessing a generally semicircular shape, having a straight edge portion 235A and a rounded edge portion 240A. The body 230A further includes a truncated area 245 along its proximal portion that is configured to frictionally mesh with a protruding area on the second shutter 220A. The second shutter member 220B includes a body 230B possessing a generally semicircular shape, defining a generally straight edge portion 235B and a generally rounded edge portion 240B. The rounded edge portions 240A, 240B of the shutter members 220A, 220B may possess a radius of curvature that corresponds to the radius of curvature of the side wall 105 inner surface. With this configuration, the rounded edge portions 240A, 240B are contoured to their respective side wall area.

The second shutter member 220B further includes a lever 250 extending radially from the body 230B. The base 252 of the lever 250 is configured to engage the truncated area 245 of the first shutter body 230A such that rotation of the second shutter member 220B causes an opposite rotation in the first shutter member 220A (explained in greater detail below). The distal portion of the lever 250 of the second shutter member 220B extends through an elongated slot 255 formed into side wall 105 of the housing 100. The slot 255 may define the travel length an operator may move the lever 250 during operation.

Figure 3A:
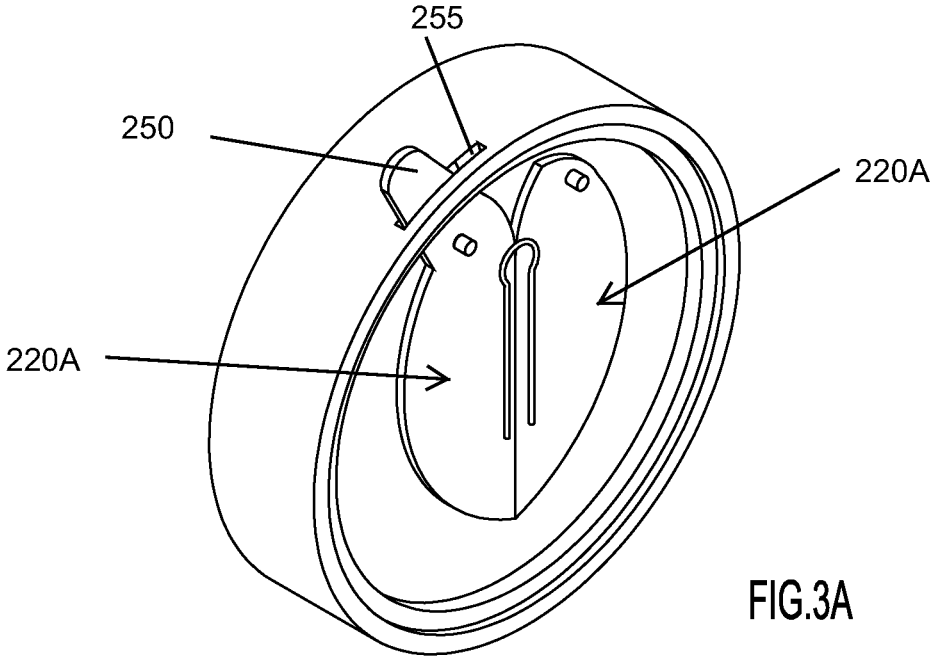
FIGS. 3A and 3B illustrate rear perspective views of the security cover shown in FIG. 1A, with the eyecup and back panel removed to show the operation of the shutter mechanism.
Figure 3B:
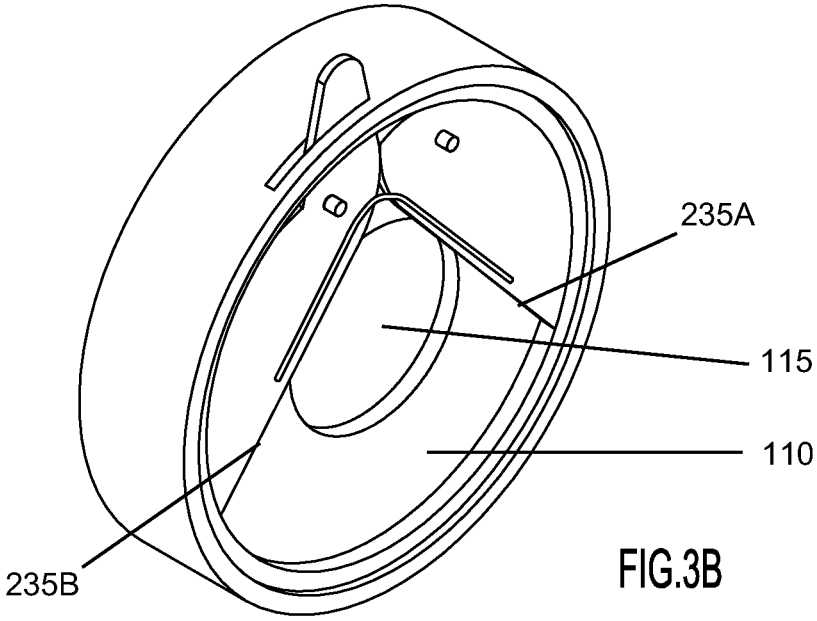

The operation of the security cover 10 is explained with reference to FIGS. 3A and 3B. The biasing member 225 biases the shutter members 220A, 220B in a normal or closed position, in which the straight edge portions 235A, 235B of the shutter members 220A, 220B contact each other. In this position, the body 230A, 230B of each shutter member 220A, 220B at least partially blocks the forward aperture 115. As such, a viewer positioned on the inside of the door cannot see through the cover 10. Similarly, a viewer positioned on the outside of the door cannot see light variations through the door viewer, and cannot view the area proximate the interior door surface. Should an inside viewer desire to look through the door viewer, the inside viewer engages the lever 250 to rotate the upper circle of the second shutter member 220B (i.e., the base 252) toward the upper circle of (i.e., truncated portion 245) the first shutter member 220A (e.g., in a clockwise direction from the perspective of FIG. 3B). Rotation of the second shutter member 220B causes the base 252 of the lever 250 to frictionally engage the truncated portion 245 of the first shutter member 220A; consequently, the clockwise rotation of the second shutter member 220B rotates the first shutter member 220A in counterclockwise direction. As a result, the shutter members 220A, 220B separate, moving from the normal, closed position (FIG. 3A) to an opened position (FIG. 3B). Since the outer rounded edges 240A, 240B of the shutter members 220A, 220B are contoured to the inner surface of the side wall 105, the shutter members abut the side wall. With this configuration, in the opened position, the bodies 230A, 230B of the shutter members 220A, 220B clear the forward 115 and rearward 125 apertures enabling an inside viewer may see through the cover 10 and the door viewer device.

Thus, the present invention provides an inexpensive, easily operated device that can be attached to any conventional door including a door viewer. The cover 10 is biased in its closed position; consequently, an outside viewer (i.e., a viewer positioned along the front of the door) cannot look through the door viewer to see into the secured structure (e.g., house, apartment, etc.). In addition, the outside viewer cannot see any light variation that occurs as an inside viewer approaches the door viewer device. Should an inside viewer desire to look through the door viewer device, the inside viewer user simply places an eye against the eyecup 130, further shielding the door viewer device from light, and then engages the lever 250 to open the shutter mechanism as described above. The inside viewer may now view the outside viewer to confirm the outside viewer's identity. During the viewing process, the outside viewer remains unaware of the presence of the inside viewer since no light variation can be detected.

Figure 4:
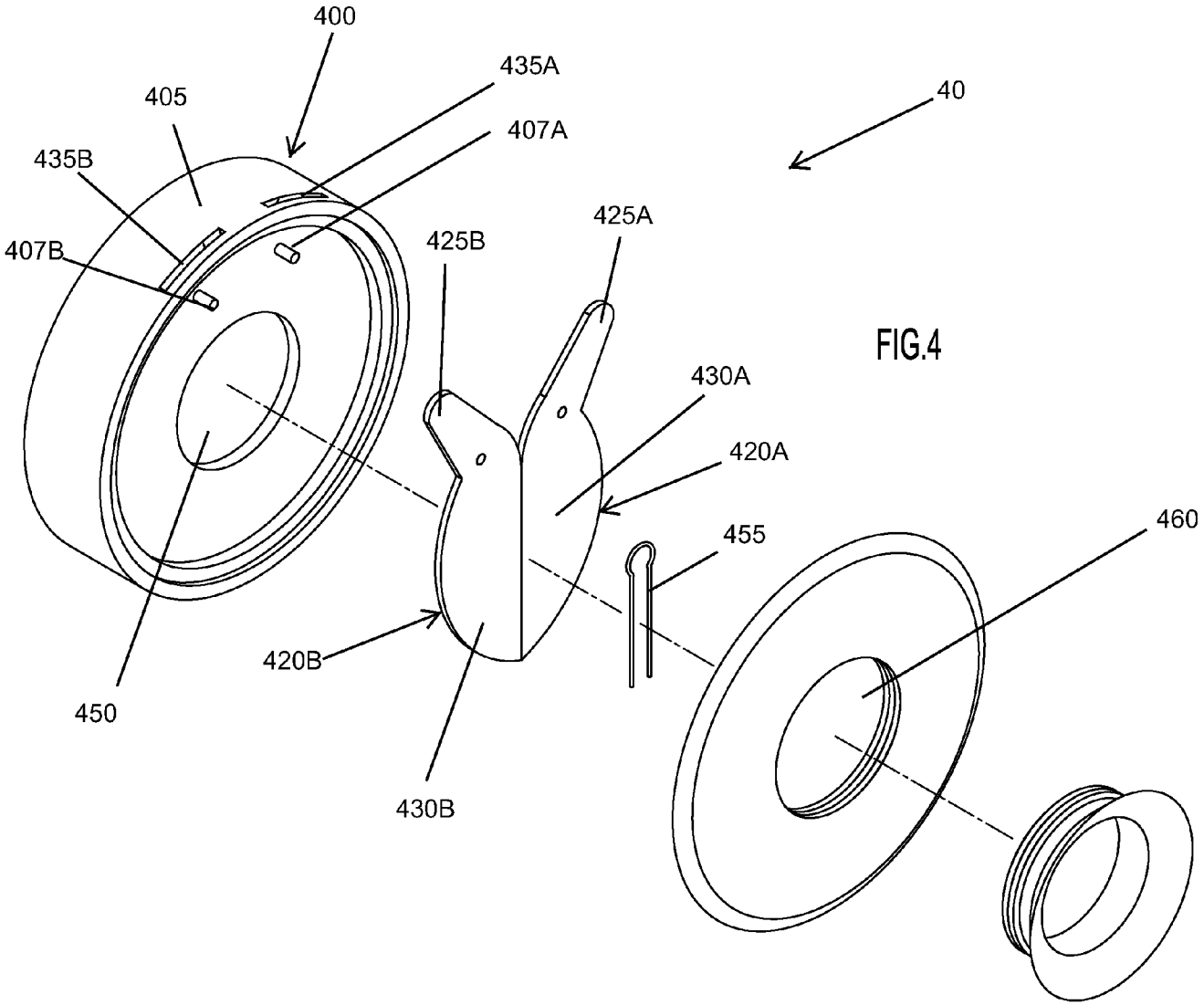
FIG. 4 illustrates an exploded view of a security cover in accordance with another aspect of the present invention.

FIG. 4 illustrates a security cover 40 for a door viewer device in accordance with another aspect of the invention. As shown, the cover 40 includes a structure similar to that described above, including a housing 400 with a side wall 405, and axially extending posts 407A, 407B disposed on the rear side 410 of a forward plate 415. This configuration further includes a first shutter member 420A including a first lever 425A and a first body 430A, as well as a second shutter member 420B including a second lever 425B and a second body 430B. That is, instead of the mechanism including a single lever that controls both shutter members, each shutter member 420A, 420B now includes a lever 425A, 425B extending radially from the body 430A, 430B. The shutter bodies 430A, 430B, moreover, may no longer be geared together. The housing 400 further includes a first slot 435A associated with the first lever 425A and a second slot 435B associated with the second lever 425B.

Figure 5A:
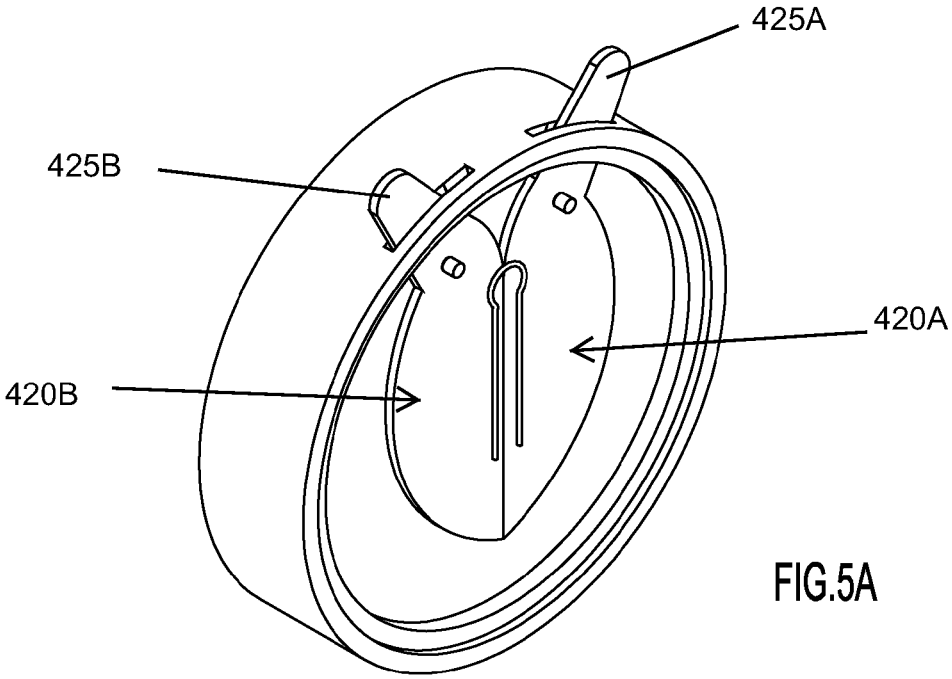
FIGS. 5A and 5B illustrate rear perspective views of the security cover shown in FIG. 4, with the eyecup and back panel removed to show the operation of the shutter mechanism.
Figure 5B:
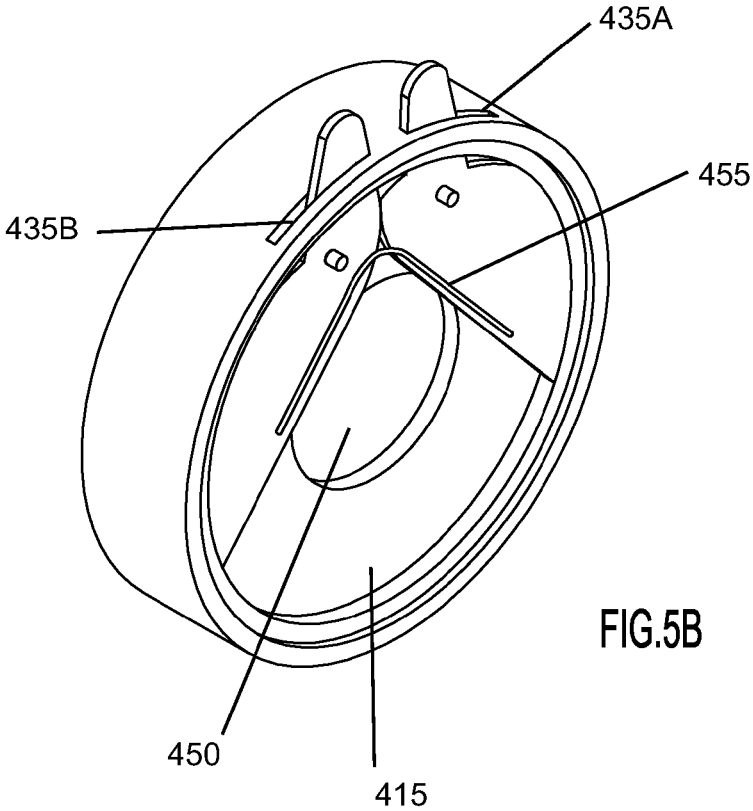

In operation, the shutter mechanism beings in its normal, closed position as shown in FIG. 5A. The inside viewer engages the levers 425A, 425B, driving them toward each other (e.g., the operator squeezes the levers together). Each shutter member 420A, 420B pivots on its respective post 407A, 407B such that the first shutter member 420A rotates in one direction (e.g., a counterclockwise direction) while the second shutter member 420B rotates in an opposite direction (e.g., a clockwise direction). The shutter members 420A, 420B are rotated until the bodies 430A, 430B clear the forward 450 and rearward 460 apertures. Once clear of the forward aperture 450 clear the inside viewer may look though the security cover 10 and the door viewer device to investigate the area proximate the front of the door. Once the levers 405A, 405B are released, the biasing member 455 drives the shutter members 420A, 420B back to their normal (closed) position, in which each body 430A, 430B at least partially blocks the forward aperture 450.

Figure 6:
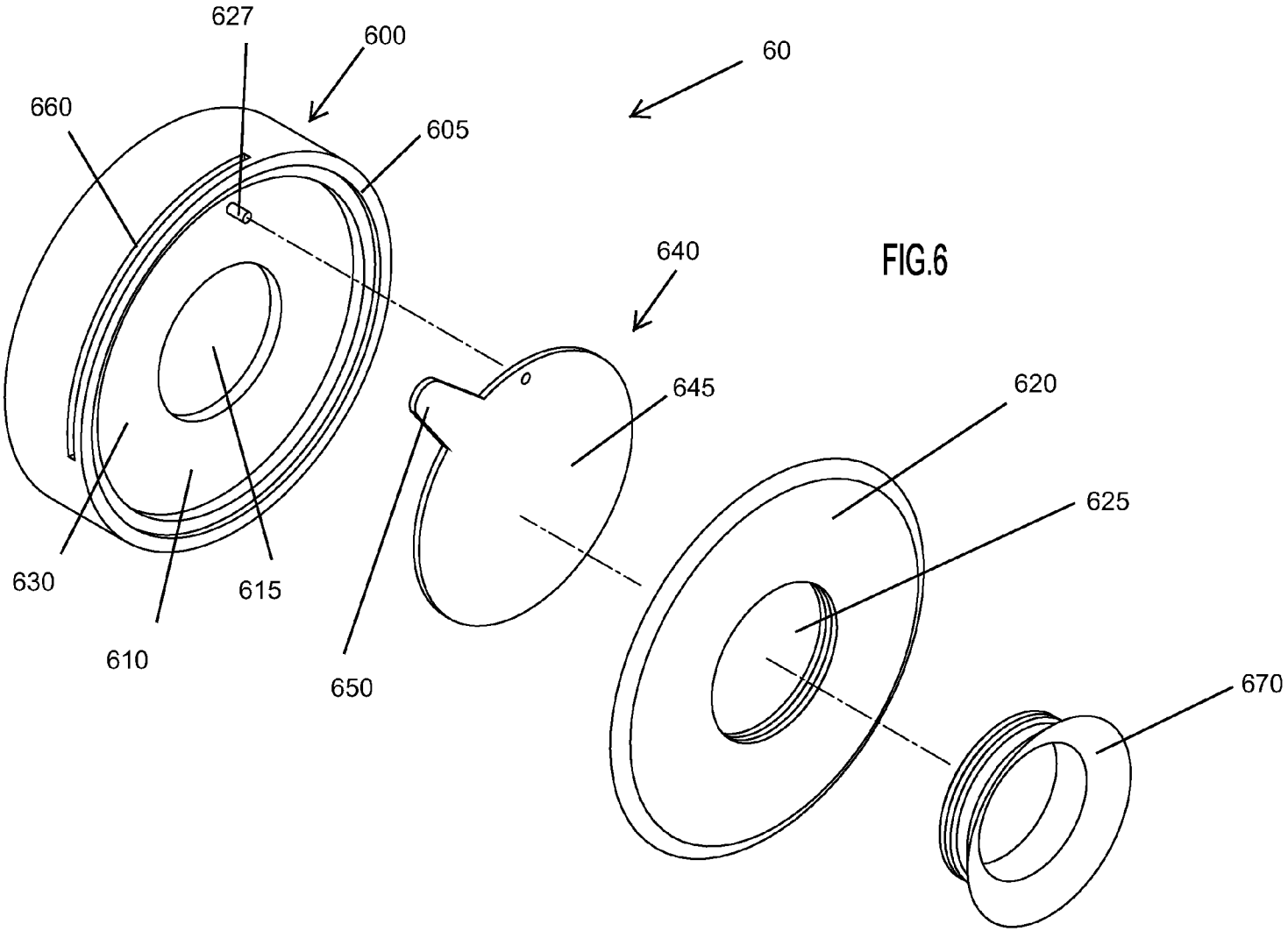
FIG. 6 illustrates an exploded view of the security cover in accordance with another aspect of the present invention.

FIG. 6 illustrates a security cover for a door viewer device in accordance with another aspect of the invention. As shown, the security cover 60 includes a housing 600, including a side wall 605 with a forward plate 610 defining a forward aperture 615, a rearward plate 620 defining a rearward or viewing aperture 625, and an axial post 627 extending distally from the rear side 630 of the forward plate 610. The cover 60 further includes a single shutter member 640 including a generally circular body 645 and a lever 650 extending radially therefrom. The side wall 605 of the housing 600 further includes a slot 660 that enables passage of the shutter member 640 therethrough. As with the other embodiments, the cover 60 further includes an eyecup 670 secured to the rearward plate 620.

Figure 7A:
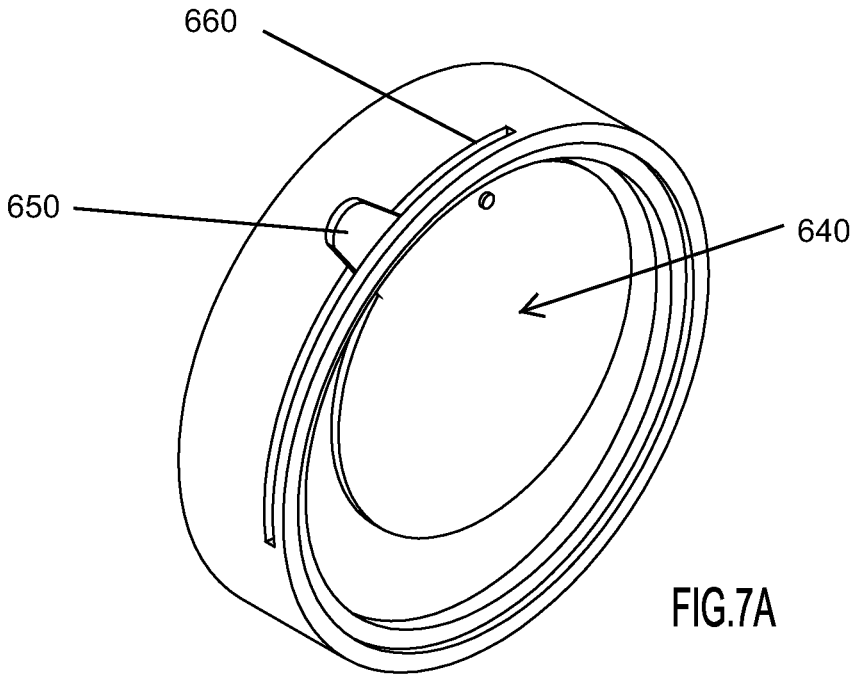
FIGS. 7A and 7B illustrate rear perspective views of the security cover shown in FIG. 6, with the eyecup and back panel removed to show the operation of the shutter mechanism.
Figure 7B:
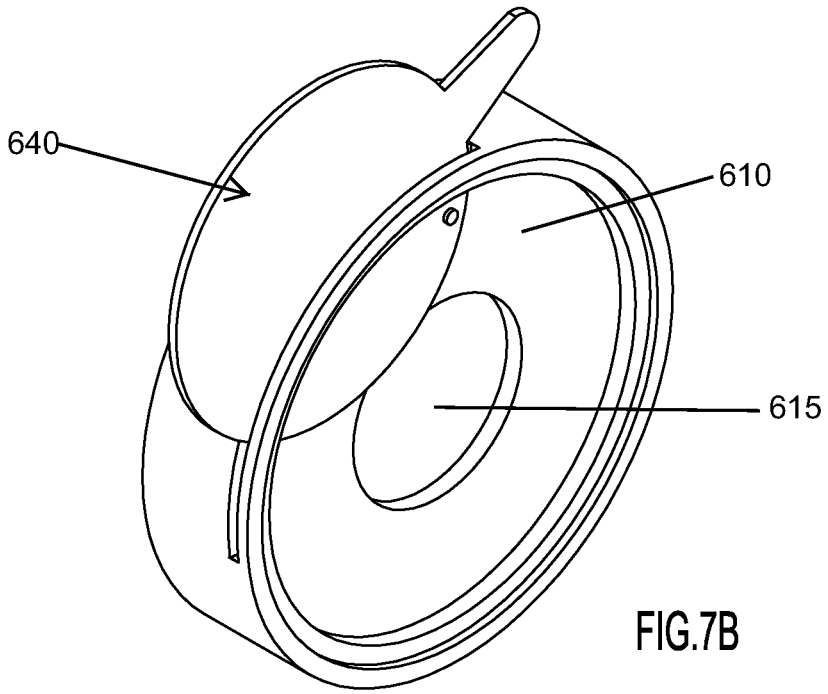

Operation of the device is explained with reference to FIGS. 7A and 7B. As shown, pivoting the lever 650 drives the body 645 of the shutter member 640 out of alignment with the viewing aperture 625, enabling an inside viewer to look through the door viewer device. Releasing the lever 650 returns the shutter member 640 to its normal closed position, via gravity.

Figure 8:
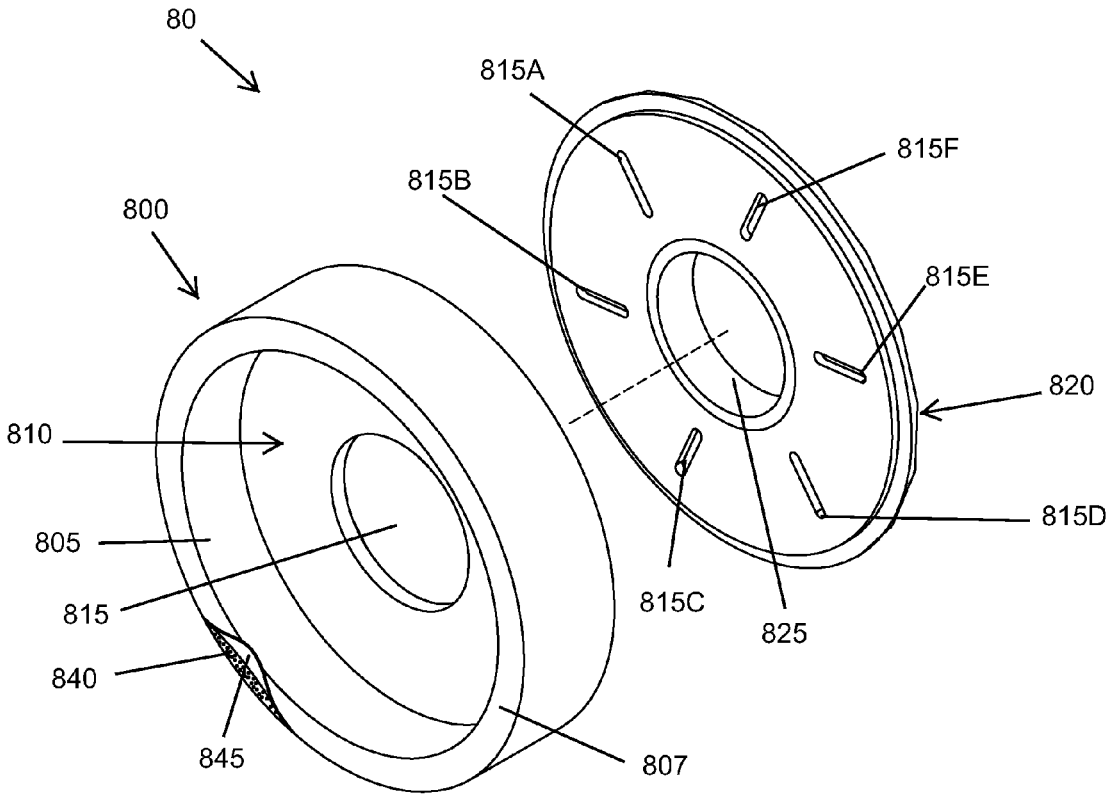
FIG. 8 illustrates an exploded view of a security cover in accordance with another aspect of the invention.

FIGS. 8-10 illustrate a security cover for a door viewer device in accordance with another aspect of the invention. As illustrated, the security cover 80 includes a housing 800 including a side wall 805 defining a rim 807, a forward annular plate 810 defining a forward aperture 815, and a rearward annular plate 820 defining a rearward or viewing aperture 825. As shown, the rim 807 is further coated with an adhesive 840, which, in turn, is covered with release paper 845.

Figure 9A:
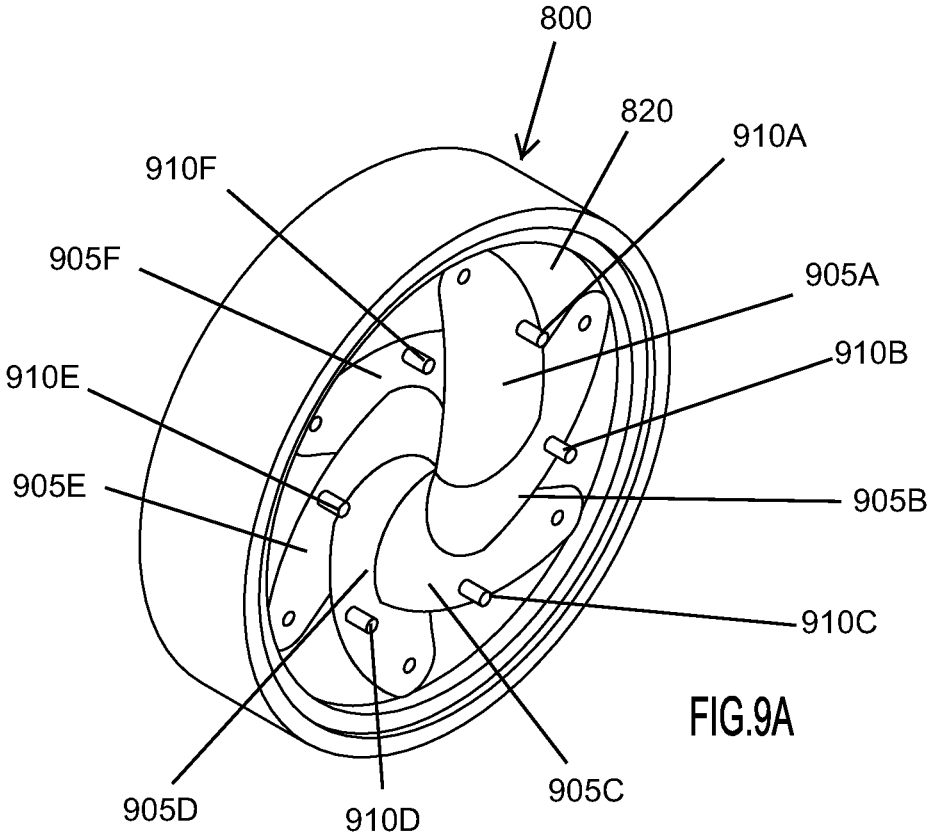
FIGS. 9A and 9B illustrate rear perspective views of a security cover in accordance with an aspect of the invention, with the eyecup and back panel removed to show the shutter mechanism in its closed and open positions, respectively.
Figure 9B:
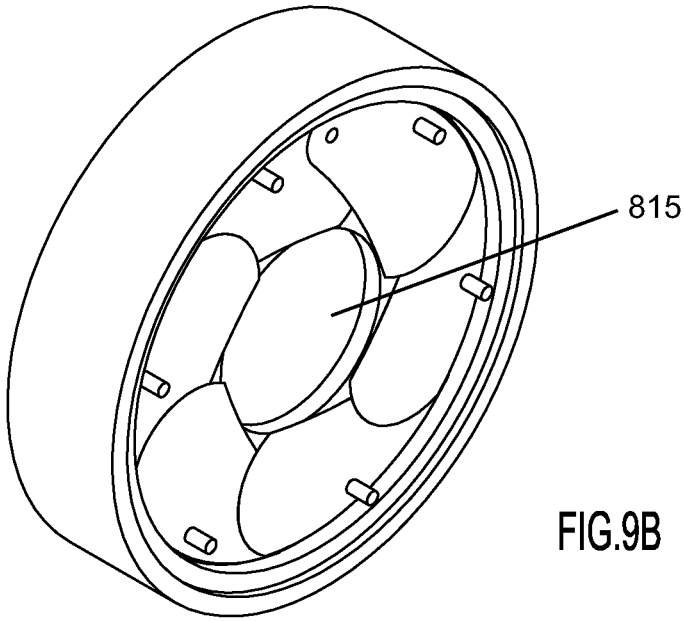

Referring to FIGS. 9A and 9B, the shutter mechanism includes a plurality of blades 905A-905F pivotally coupled to the rear side of the forward plate 810 via a post extending from the forward plate rear side in a manner similar to that described above (posts not shown). Each blade 905A-905F possesses a generally tear-drop shape including a proximal narrower end and a distal wider end. Each blade includes a follower pin 910A-910F disposed at an intermediate location along the blade, proximate blade outer edge. In addition, the rearward plate 820 further includes a plurality of radial slots 815A-815F angularly spaced about the plate. Each follower pin 910A-910F is captured within its respective slot 815A-815F, with the slot defining the travel path of each blade.

Figure 10A:
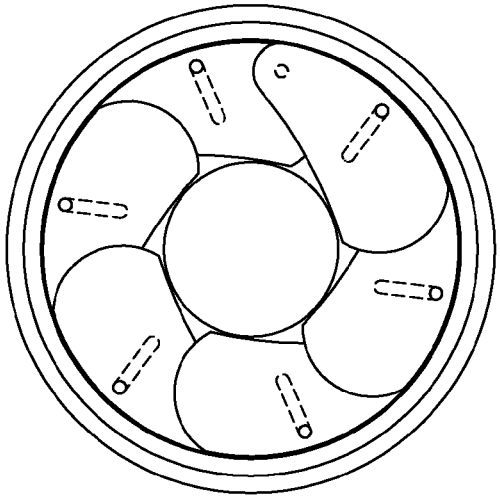
FIGS. 10A, 10B, and 10C illustrate rear plan views of the device of FIG. 9A, showing the operation of the shutter mechanism.
Figure 10B:
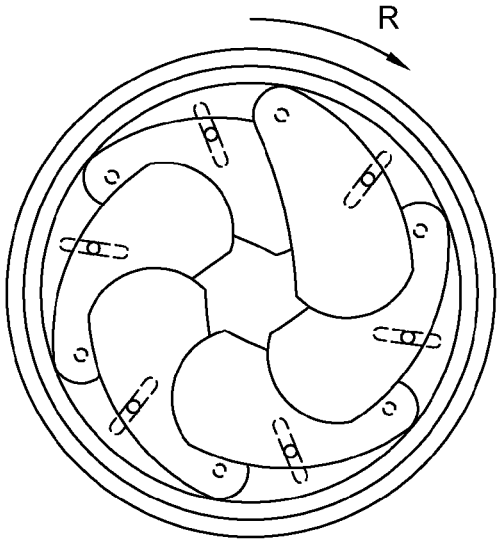
Figure 10C:
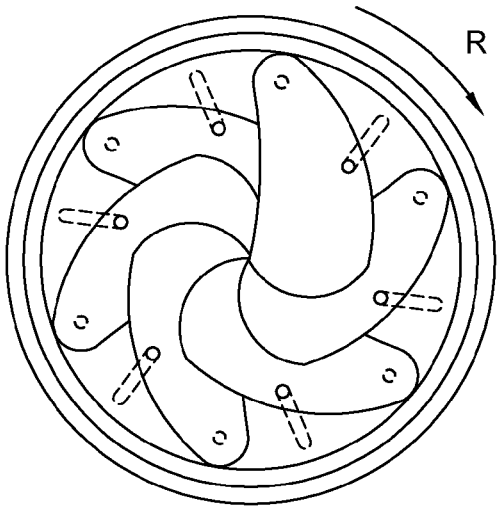

Referring to FIGS. 10A-10C, with this configuration, rotation of the rearward plate 820 (indicated by arrow R) causes each follower pin 910A-910F to moves along its respective slot 815A-815F, pivoting each blade 905A-905F radially, rotating it from an opened position, in which each blade clears the forward aperture 815 (FIG. 10A), to a closed position (FIG. 10C), in which each blade at least partially blocks the forward aperture (FIG. 10C). That is, the wider end of the blade, defining the distal blade end, at least partially covers the forward aperture 815 in the closed position. To close the shutter mechanism, the rearward plate 820 is rotated in the reverse direction.

Figure 11:
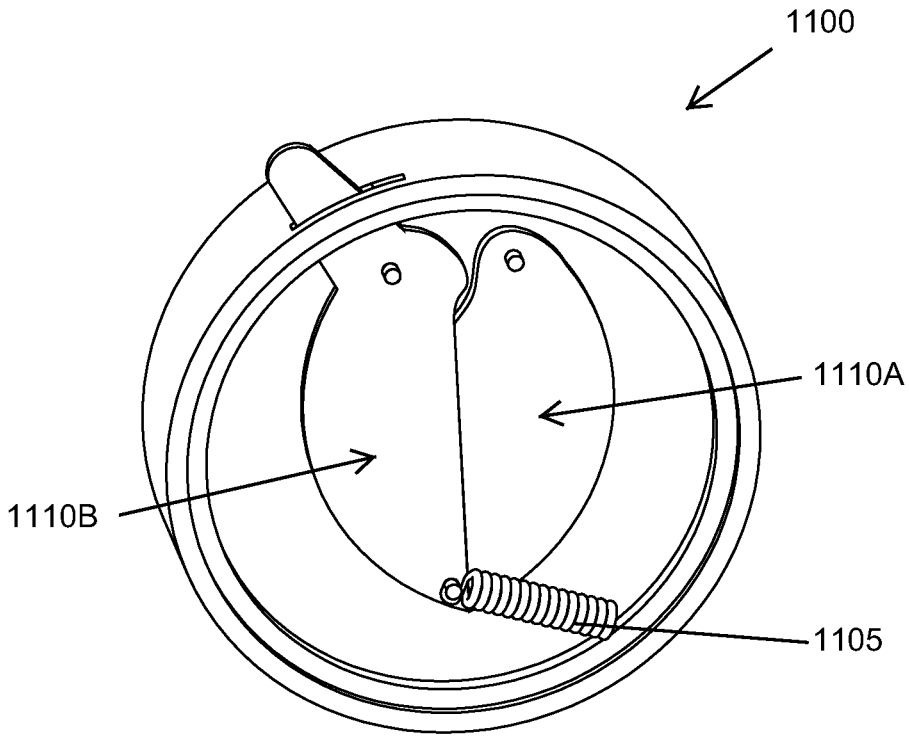
FIG. 11 illustrates a security cover for a door viewer in accordance with an aspect of the invention.

FIG. 11 illustrates a security cover for a door viewer device in accordance with an aspect of the invention. As shown, the security cover 1100 includes a structure similar to that described above in FIGS. 1A and 1B. In this configuration, however, the biasing member 1105 is a coil spring coupled to the distal end of the second shutter member 1110B. As with the embodiment described above regarding FIG. 1A, movement of the second shutter member 1110B generates a corresponding movement in the first shutter member 1110A.

While the invention has been described in detail and with reference to specific embodiments thereof, it will be apparent to one skilled in the art that various changes and modifications can be made therein without departing from the spirit and scope thereof. For example, the shutter mechanism may include a gear system in which the first shutter member includes teeth that mesh with corresponding teeth on the second shutter member. Thus, it is intended that the present invention covers the modifications and variations of this invention provided they come within the scope of the appended claims and their equivalents. It is to be understood that terms such as "top", "bottom", "front", "rear", "side", "height", "length", "width", "upper", "lower", "interior", "exterior", and the like as may be used herein, merely describe points of reference and do not limit the present invention to any particular orientation or configuration.

I claim:

1. A security cover for a peephole including a viewing port, the security cover comprising:

a housing comprising a channel extending from a forward opening to a rearward opening, the forward opening being aligned with the rearward opening;

a shutter disposed at an intermediate channel location between the openings, wherein the shutter is movably coupled to the housing, the shutter including a disc portion and a lever portion;

a slot formed into the housing; and an eyecup coupled to a rearward end of the housing, wherein the lever portion of the shutter passes through the slot formed into the body such that the lever portion extends radially from the housing, and wherein engaging the lever portion moves the disc portion from a first shutter position, in which viewing through the security cover via the eyecup is prevented, to a second shutter position, in which viewing through the security cover via the eyecup is permitted, wherein an annular portion of the housing of the security cover is adapted to directly couple to an exterior surface of the door such that the security cover covers the viewing port of the peephole.

2. The security cover of claim 1 further comprising a member defining an aperture within the housing channel, wherein the shutter cooperates with the member to obstruct the aperture when the shutter is oriented in the first shutter position.

3. The security cover of claim 2, wherein the member is annular.

4. The security cover of claim 2, wherein:

the member is a first member;

the aperture is a first aperture;

the security cover further comprises a second member defining a second aperture; and the shutter further cooperates with the second member to obstruct the second aperture when the shutter is oriented in the first shutter position.

5. The security cover of claim 4, wherein the second member is annular.

6. The security cover of claim 4, wherein each of the first member and the second member is an annular plate.

7. The security cover of claim 4, wherein:

the first member is axially spaced from the second member such that the first member is positioned forward of the second member; and the security cover further comprises a post extending axially rearward from the first member, the shutter being pivotally coupled to the post.

8. The security cover of claim 1, wherein:

the housing comprises a generally cylindrical body with a curved interior surface; and the disc portion of the shutter is contoured to curved interior surface of the housing.

9. The security cover of claim 1 further comprising adhesive operable to secure the security cover to a door proximate a peephole installed in the door.

10. The security cover of claim 1, wherein:

in the first shutter position the disc portion is oriented within the housing; and in the second shutter position, the disc portion is oriented such that the disc portion extends out from the housing.

11. The security cover of claim 1, wherein a forward end of the housing includes a layer of adhesive operable to couple the security cover to the exterior surface of the door.

* * * * *